United States Patent [19]

Anders

[11] Patent Number: 4,542,786

[45] Date of Patent: Sep. 24, 1985

[54] HEAT EXCHANGER CORE WITH VARIED-ANGLE TUBES

[75] Inventor: Gene A. Anders, Peoria, Ill.

[73] Assignee: Caterpillar Tractor Co., Peoria, Ill.

[21] Appl. No.: 588,862

[22] PCT Filed: Nov. 30, 1981

[86] PCT No.: PCT/US81/01604

§ 371 Date: Nov. 30, 1981

§ 102(e) Date: Nov. 30, 1981

[87] PCT Pub. No.: WO83/01997

PCT Pub. Date: Jun. 9, 1983

[51] Int. Cl.[4] ..... F28F 1/32

[52] U.S. Cl. ..... 165/144; 165/151; 165/172; 165/DIG. 13

[58] Field of Search ..... 165/149, 150, 151, 152, 165/172, 143, 144, 145, DIG. 13

[56] References Cited

U.S. PATENT DOCUMENTS

| | | | |
|---|---|---|---|
| 1,996,691 | 4/1935 | Tenney . | |
| 2,006,649 | 7/1935 | Modine . | |
| 4,034,804 | 7/1977 | Meijer et al. | 165/148 |
| 4,076,072 | 2/1978 | Bentz | 165/41 |
| 4,144,933 | 3/1979 | Asselman et al. | 165/151 X |

FOREIGN PATENT DOCUMENTS

| | | | |
|---|---|---|---|
| 412094 | 12/1935 | Belgium . | |
| 463767 | 4/1946 | Belgium . | |
| 685849 | 7/1930 | France | 165/151 |
| 794271 | 2/1936 | France | 165/151 |
| 924331 | 4/1947 | France | 165/151 |
| 2250088 | 5/1975 | France . | |
| 2264262 | 10/1975 | France . | |
| 130998 | 8/1983 | Japan | 165/151 |
| 255544 | 1/1949 | Switzerland | 165/151 |
| 513199 | 10/1939 | United Kingdom | 165/151 |

OTHER PUBLICATIONS

80/01104, 5-80, WO, Heston et al.
83/01997, 6-83, WO, Anders.

*Primary Examiner*—Sheldon J. Richter
*Attorney, Agent, or Firm*—Anthony N. Woloch

[57] ABSTRACT

Heat exchangers depend for efficiency upon maximizing fluid flow, such as air, through their fins about tubes extending through the fins. The air flow, particularly at the ends of a heat exchanger, can sometimes be of a significantly reduced amount owing to flow restrictions caused by the construction of, or arrangement of elements in, a heat exchanger. A core (12) of a heat exchanger (10) of the present invention utilizes a relatively varied angular arrangement for tubes (16) in the core (12) which improves air flow, particularly at the ends (28,40) of the core (12). Air flow is thus improved over a portion of the heat exchanger (10) to increase heat transfer, as well as purging of debris, for the folded or zipzag core arrangement described.

3 Claims, 4 Drawing Figures

HEAT EXCHANGER CORE WITH VARIED-ANGLE TUBES

DESCRIPTION

1. Technical Field

The invention relates to a heat exchanger core and, more particularly, to the relative orientation of tubes, having an elongated cross-sectional configuration, in the core.

2. Background Art

In the use of a heat exchanger, heat dissipation characteristics can be maximized by maintaining a proper flow of fluid across all portions of the heat exchanger core.

For example, work vehicles often provide limited space in which to position a heat exchanger to cool engine oil or coolant or hydraulic fluid. One solution is to utilize a folded core heat exchanger which positions cores of the heat exchanger at angles relative to one another or in a zigzag pattern. This provides more heat transfer surface area for a given width in which to place the cores. Such an application is shown in U.S. Pat. No. 4,076,072 which issued to Bentz on Feb. 28, 1978.

The use of the folded core heat exchangers does, however, result in different air flow characteristics through the core because of the folded or zigzag arrangement of the cores. Also, because of the space limitations which restrict the size of the folded core heat exchanger, it is desirable to more efficiently utilize the entire surface area of a core to maximize the thermal efficiency of the cores.

One solution is disclosed in U.S. Pat. No. 4,034,804 which issued to Meijer et al on July 12, 1977. In this patent the hydraulic diameter and lengths of the tubes are specifically selected to increase the cooling capacity of the disclosed radiator. However, even with such a radiator, air flow can sometimes be substantially blocked from flowing through the fins and about the tubes in portions of the core. Such problems generally result from mounting brackets, covers or the arrangement of the fins or tubes themselves blocking or restricting the optimum pathway of the air through the heat exchanger.

The present invention is directed to overcoming one or more of the problems set forth above.

DISCLOSURE OF THE INVENTION

In one aspect of the present invention, a heat exchanger core has a plurality of tubes extending through a plurality of fins. Each of the tubes has an elongated cross-sectional configuration defining a major axis. The major axis of a preselected one of the tubes defines an angle with an axis of the core. The major axes of preselected other ones of the tubes each define angles with the core axis greater than the angle of the preselected one of the tubes.

In another aspect of the present invention, a heat exchanger core has a plurality of tubes extending through a plurality of fins. A fluid stream oriented in a flow direction is utilized by the heat exchanger. A major axis of a preselected one of the tubes defines an angle relative to the flow direction. Major axes of the other tubes define angles relative to the flow direction greater than the flow direction angle of the preselected one of the tubes.

The heat exchanger efficiency is improved by positioning the tubes in the core at relatively varied angles.

The different angles improve fluid flow through certain portions of the heat exchanger core by reducing the pressure drop or fluid flow restriction through the heat exchanger core in order to better utilize the heat transfer surface area of the core as well as to help purge debris from the heat exchanger.

BEST MODE FOR CARRYING OUT THE INVENTION

Figure 1:
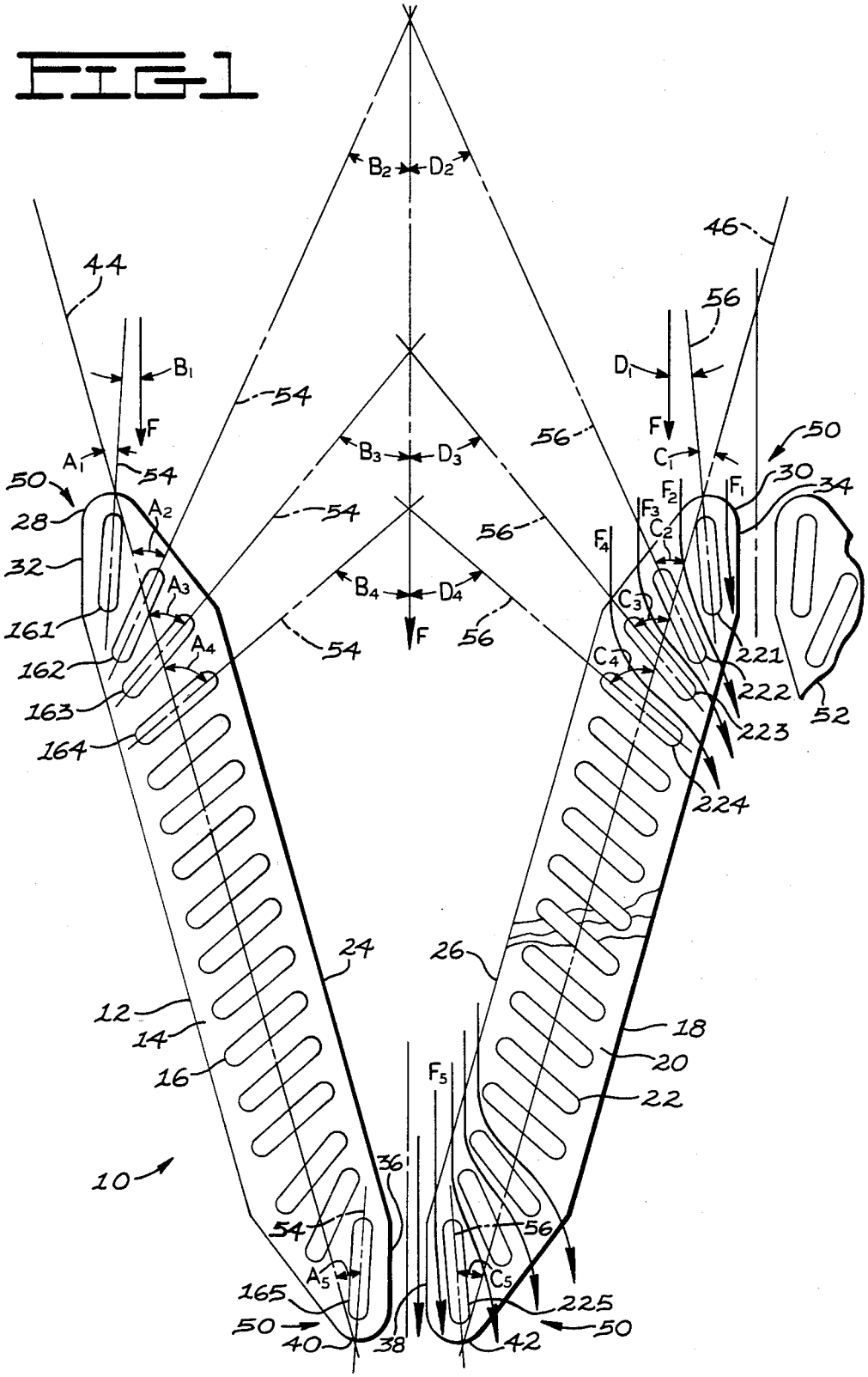
FIG. 1 is a diagrammatic representation of one embodiment of the present invention as incorporated on a folded core heat exchanger such as might be used on a work vehicle.

Referring to FIG. 1, a top view of a heat exchanger 10 is shown which includes a first core 12 having a first plurality of stacked and generally closely spaced fins 14 having a generally straight elongated configuration. A first plurality of tubes 16 extends through the fins of the first core. A second core 18 is defined by a second plurality of stacked and generally closely spaced fins 20 having a generally straight elongated configuration through which extends a second plurality of tubes 22. The first and second cores each have an inlet surface 24,26, an inlet or leading end 28,30, an inlet end surface 32,34, an outlet end surface 36,38, an outlet or trailing end 40,42 and a longitudinal axis 44,46. The cores are arranged in a general "V" configuration to define preselected fold angles 48 (FIGS. 2 and 3) relative to the longitudinal axes 44,46 of the respective cores. The core axes 44,46 extend between the related inlet and outlet ends of the cores 12,18 and the related plurality of tubes 16,22 are each arranged in a single, substantially-straight row between the related inlet and outlet ends generally perpendicular, in a longitudinal relationship, to their related core axis 44,46 and the planes of their related fins 14,20.

Figure 4:
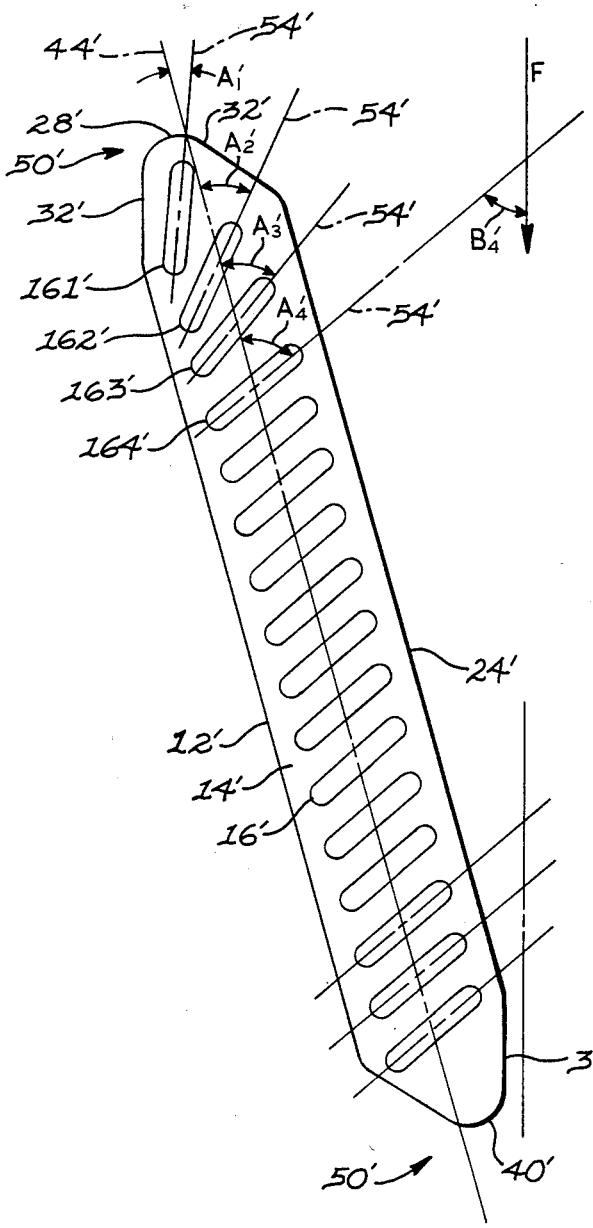
FIG. 4 is a diagrammatic representation of another embodiment of the present invention as incorporated on a single core such as might be typical of cores assembled to form a folded core heat exchanger.

In FIG. 4, a core 12' is shown similar in configuration and orientation to the first core 12 of FIG. 1, with the exception of the arrangement of the tubes at its outlet end 40'. Such a core arrangement can be used to construct a heat exchanger 10 as shown in FIG. 1. For convenience, therefore, reference will be made primarily to the cores in FIG. 1. It should be understood that such description relating to the first core will also apply to the core of FIG. 4 with the exception of differences noted. The elements of the core of FIG. 4 have, therefore, the same reference numerals, but with prime notations, as the corresponding elements of the first core of FIG. 1.

Figure 2:
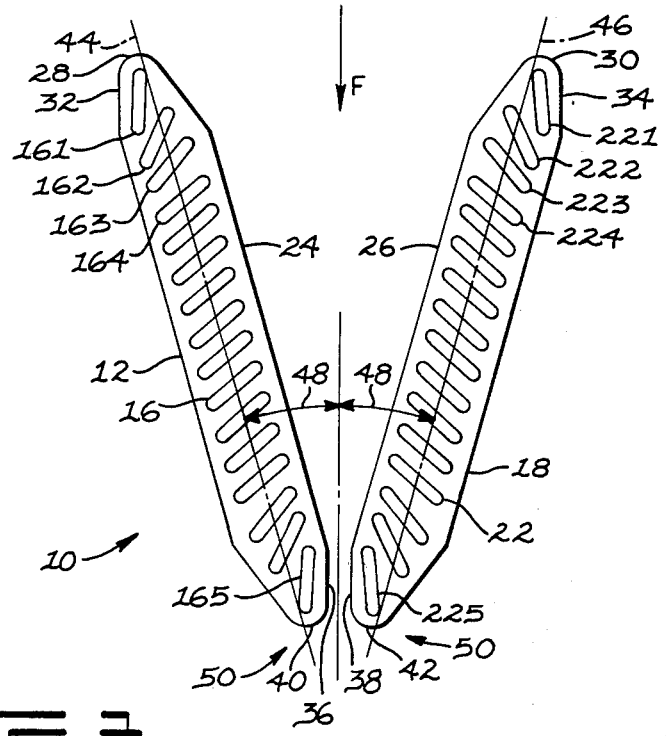
FIG. 2 illustrates the embodiment of FIG. 1 at a relatively compact fold angle.
Figure 3:
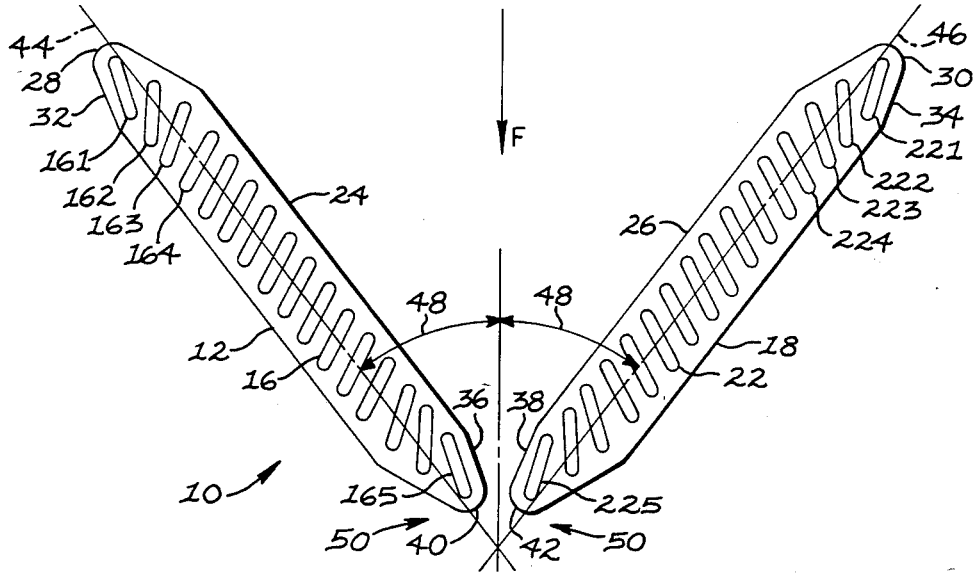
FIG. 3 illustrates the embodiment of FIG. 1 at a relatively wide fold angle.

The "V" configuration of the cores 12,18 maximizes the useful heat transfer surface area of the heat exchanger 10 of a given width for better utilizing a fluid stream oriented in a flow direction F relative to the heat exchanger. The fluid stream is received, or initially impinges, at and along the inlet surfaces 24,26 with the direction of flow being oriented generally from the inlet ends 28,30 toward the outlet ends 40,42. In other words, the inlet end is that end of a core which is positioned forwardly of the outlet end in the fluid stream. As is shown, the outlet ends 40,42 are spaced apart a preselected distance, for example about 6.5 mm (0.26 in.), to facilitate flow through of debris encountered by the heat exchanger. Moreover, the fins 14,20 at the ends 28,40,30,42 of the cores 12,18 include angular position means 50 for pivotably maintaining a constant preselected spacing between the adjacent cores 12,18, at the converging end of the "V" configuration. As illustrated in FIGS. 2 and 3, during assembly, the cores 12,18 may be pivoted about their outlet ends 40, 42 to attain the preselected fold angles 48 of the cores 12,18. The angular position means 50 includes the fins 14,20 being radiused at the inlet and outlet ends of the cores according to preselected arcs.

A third core 52 is arranged in a general "V" configuration with the second core 18. Additional cores can be likewise positioned with respective adjacent cores to increase the heat transfer capacity of the heat exchanger 10 and the heat exchanger 10 may, for example, be incorporated in the heat exchanger mounting apparatus disclosed in U.S. Pat. No. 4,295,521 issued to Sommars on Oct. 20, 1981.

Referring now to the first core 12 shown in FIG. 1, by way of illustration, the first plurality of tubes 16 includes all tubes extending through the first core. Each of the tubes has an elongated cross-sectional configuration which defines a major axis 54 which extends longitudinally across the cross section of the tube. The tube major axes 54 define preselected angles A with the axis 44 of the first core whereby the preselected angles A vary depending upon the location of a particular tube in the core.

For example, a first preselected one of the first plurality of tubes 16, or first tube in the first core 12 at the inlet end 28, is identified by reference numeral 161 and defines the angle $A_1$. The angle $A_1$ is less than the related respective angle of at least one of the other ones of the first plurality of tubes. In the embodiment shown, the angle $A_1$ is less than the angles defined by preselected other ones of the tubes which include a second preselected one 162, or second tube, and a third preselected one 163 or third tube, which define the angles $A_2$ and $A_3$, respectively. Similarly, the preselected angle $A_2$ is greater than the angle $A_1$ and less than the angle $A_3$. The second tube 162 as shown is positioned between the first tube 161 and the remaining tubes in the first core with the third tube 163 being the next tube adjacent the second tube 162. The angle $A_1$ is also less than angle $A_4$, formed by a fourth preselected one or central tube 164, which is representative of the orientation of the tubes in the first core other than the three tubes nearest each of the inlet and outlet ends 28,40, as will be further explained.

At the outlet end 40 of the first core 12, the nearest three tubes in the core are positioned in a symmetrical angular relationship relative to the first, second and third tubes 161,162,163 at the inlet end 28. Particularly, for example, another or fifth preselected one 165 or last tube defines the angle $A_5$ which is the same as the angle $A_1$ of the first tube 161. Thus, in FIG. 1, the angle $A_1$ is of lesser magnitude than angles A defined by all tubes in the first core other than the last tube 165. In the alternative embodiment of FIG. 4, in which the plurality of tubes 16' also includes all tubes extending through the core 12', it will be seen that the three tubes nearest the outlet end 40' are oriented the same as the central tube 164' while the first three tubes 161',162',163' nearest the inlet end 28' are oriented the same as their corresponding tubes 161,162,163 in the first core 12 of FIG. 1. Thus, the angle $A_1'$ defined by the first tube is less than the angles $A_2',A_3',A_4'$ defined by all the remaining tubes, including those at the outlet end 40'. It will be further seen in FIG. 4 that the relatively varied-angle tubes 161',162',163' can also be located at the outlet end of the core by merely reversing the orientation of the core relative to the fluid stream for a particular application.

The tube major axes 54 of the first core 12 in FIG. 1 also have preselected fluid incidence angular relationships B relative to the flow direction F whereby the preselected angles B vary depending upon the location of a particular tube in the core. For example, the angle $B_1$ of the first tube 161 is less than angles $B_2,B_3,B_4$ of the second, third and fourth tubes 162,163,164. The angle $B_2$ of the second tube 162 is in turn less than the angles $B_3$ and $B_4$. Note that in FIG. 1 the three tubes of the first core 12 nearest the outlet end 40 also have angular relationships relative to the flow direction which are substantially the same as the relationships $B_1,B_2,B_3$ of the first three tubes 161,162,163 nearest the inlet end 28, while in FIG. 4 the three tubes nearest the outlet end 40' of the core 12' have angular relationships relative to the flow direction which are the same as the angular relationship $B_4'$ of the central tube 164'.

In FIG. 1, each of the tubes of the second plurality of tubes 22 in the second core 18 has an elongated cross-sectional configuration which defines a major axis 56 which is oriented so it has similar or corresponding angular relationships which were explained for the first core 12 above. For example, the major axes 56 of the first three tubes 221,222,223 nearest the inlet end 30 and the representative central tube 224 define corresponding angles $C_1,C_2,C_3,C_4$ respectively relative to the longitudinal core axis 46 and corresponding angles $D_1,D_2,D_3,D_4$ respectively relative to the air flow direction F. The three tubes nearest the outlet end 42 of the second core 18 also are similarly oriented relative to the first three tubes 221,222,223 nearest the inlet end 30 of the second core.

It should be understood that the heat exchanger 10 and particularly the tubes can be of other configurations in the art while exhibiting the principle of the varying incidence angles of the present invention without departing from the invention. For example, more than the first three or all of the tubes can be oriented at progressively changing angles or adjacent tubes can have the same angles which change from adjacent group to adjacent group.

INDUSTRIAL APPLICABILITY

In the use of the heat exchanger 10 such as is shown in FIG. 1, the fluid stream, which is commonly a flow of air induced by a fan or movement of an associated vehicle, passes through the cores 12,18 to dissipate heat transferred to the fins 14,20 by fluid, such as engine coolant, conducted through the tubes 16,22. The heat transfer efficiency of the heat exchanger 10 depends therefore upon maximizing the flow of the air past as many of the tubes and through as much of the finned area as possible. Also, effective purging of debris, which typically rolls along the inlet surfaces 24,26 of the first and second cores 12,18 and tends to accumulate in the vee formed at the outlet ends 40,42 prior to being purged through the gap between the cores, can be favorably influenced by improved tangential air flow in the vee area.

The decreased angle of, for example, the first tube 221 of the second core 18 relative to the flow direction F of the air stream, as well as relative to the longitudinal axis 46 of the second core, induces the air flow characteristics at the inlet end 30 as is shown diagrammatically by the flow lines $F_1$. Similarly, air flow past the second and third tubes 222,223 is shown by the flow lines $F_2$ and $F_3$, respectively. The air flow through the central tubes 224 is represented by the flow line $F_4$ whereas the air flow through the remainder of the tubes nearest the outlet end 42 is represented by flow lines $F_5$.

It will be understood from the air flow lines $F_1,F_2,F_3$ in the drawing that the air flow is resultingly improved at the inlet end 30 of the second core 18, as well as with the configuration at the inlet ends 28 of the first core 12 in FIG. 1, owing to the relative angular arrangement of their tubes at the inlet ends. The flow improves owing to the full air stream impinging at the inlet end being able to pass through the fins and about the tubes. Without the improved angular arrangement, a significant portion of the air stream impinges upon the side of a first tube nearest a core inlet end and tends to be deflected out and around the tubes nearest the inlet end. This results in a certain portion of the core at the inlet end being less effective in transferring heat owing to the reduction of air flow therethrough.

As an example of the improved air flow, FIGS. 1, 2, and 3 show the angles $A_1,A_2$ and $A_3$ of the first tubes 161,162,163 nearest the inlet end 28 as well as the angles A for the three tubes nearest the outlet end 40 of the first core 12 at magnitudes of about 20°, 40°, and 55°, while the angles $A_4$ of the central tubes 164 are about 65°. The particular angles A in this example are selected to provide optimum improved air flow through the cores 12,18 for a preselected, relatively compact fold angle of about 16° as shown in FIGS. 1 and 2.

Nevertheless, in applications where relatively fewer cores and heat transfer surface area are required for a given width the cores 12,18 having the same angular relationships A,C may be oriented at a wider fold angle, for example, about 38° as shown in FIG. 3 without adversely diminishing the thermal efficiency of the individual cores since all the air incidence angles B,D decrease or at least remain relatively small as the fold angle is increased. For example, in FIG. 2 where the fold angle 48 is about 16°, the air incidence angles $B_1,B_2,B_3,B_4$ between the tube major axes 54 and the flow direction F are about 4°, 24°, 39°, and 49° respectively. When the same cores are oriented at a wider fold angle, for example about 38° as shown in FIG. 3, the air incidence angles change to −18°, 2°, 17°, and 27°, respectively, thus presenting overall less flow restriction for the incoming air. Likewise, the air incidence angles D generally decrease as the preselected fold angle 48 is increased.

Similarly, the improved angular arrangement of the tubes nearest the outlet ends 40,42 of the first and second cores 12,18 provides improved thermal efficiency of the heat exchanger 10, although it is anticipated the effect will not be as great as the amount expected at the inlet end. The outlet end tubes do, however, provide a more tangential air flow through the vee area, as is represented by the flow lines $F_5$. This tends to improve the purging of debris through the gap between the outlet ends 40,42 of the first and second cores 12,18 owing to the tendency of such air flow to better roll the debris down the inlet surfaces 24,26 to the gap.

The radiused ends 28,30,40,42 of the cores 12,18 help minimize the projected frontal area of the folded or zigzag pattern and also simplify the assembly of the pattern for any selected fold angle 48 when compared with known cores having sharp edges at their ends. As shown in FIG. 2, during assembly of the zigzag pattern one can, for example, space the radiused outlet ends 40,42 of the cores 12,18 a preselected distance, to facilitate flow through of debris, fix the position of those outlet ends, and then angularly orient the core axes 44,46 to preselected fold angles 48 by pivoting the cores 12,18 about their respective outlet ends while maintaining a constant preselected spacing between adjacent cores at the converging end of the "V" configuration.

Further, the arrangement of the tubes and the radiused ends in the first and second cores 12,18 in FIG. 1 provides a desirable symmetrical relationship between the inlet and outlet ends 28,40;30,42. Such symmetry facilitates simpler manufacturing of the heat exchanger, allows a single part number inventory of cores for assembling either side of a "V" configuration, and where the cores are reversible, permits turning of the cores to reverse the air flow through the heat exchanger. In response to the reversal, the inlet and outlet ends of the cores are switched and the back surfaces of the cores become the inlet surfaces 24,26, so that debris trapped in the fins 14,20 of the cores will be purged by the reversed air flow through the heat exchanger.

Other aspects, objects and advantages will become apparent from a study of the specification, drawings and appended claims.

What is claimed is:

1. A heat exchanger core (12) having an inlet end (28), a central portion, an outlet end (40), and a longitudinal axis (44) extending from the inlet end (28) to the outlet end (40), said core adapted to be oriented throughout a preselected range of fold angles (48) less than 90° between the core axis (44) and a general flow direction (F) of a fluid stream that the core inlet end (28) is adapted to receive, comprising:

a plurality of stacked and generally spaced fins (14) having a generally straight elongated configuration, and a plurality of tubes (16) extending generally perpendicular through the fins (14) of the core (12) and arranged in a single substantially-straight row between the inlet and outlet ends (28,40), each of said tubes (16) having an elongated cross-sectional configuration defining a respective longitudinal major axis (54) wherein the major axes (54) of the tubes (16) define respective preselected angles (A) with the core axis (44), said angles ($A_4$) of all tubes (164) in the central portion of the core (12) being of the same magnitude and less than 90°, said angles ($A_3$,$A_2$,$A_1$) of the tubes (163,162,161) nearest each end (28,40) of the core (12) being less than the angles ($A_4$) of all tubes (164) in the central portion and also progressively decreasing in magnitude from the central portion to the respective inlet and outlet ends (28,40).

2. The heat exchanger core (12), as set forth in claim 1, wherein said progressively-decreasing angles ($A_3$,$A_2$,$A_1$) of the tubes (163,162,161) nearest the inlet end (28) are symmetrical with respect to the progressively-decreasing angles of the tubes nearest the outlet end (40).

3. A heat exchanger (10) comprising:

a first core (12) having an inlet end (28), a central portion, an outlet end (40), and a longitudinal axis (44) extending from the inlet end (28) to the outlet end (40), said first core (12) including a first plurality of stacked and generally spaced fins (14) each being of a generally straight elongated configuration and a first plurality of tubes (16) extending generally perpendicular through the fins (14) of the first core (12) and arranged in a single substantially-straight row between the inlet and outlet ends (28,40), each of said first tubes (16) having an elongated cross-sectional configuration defining a respective longitudinal major axis (54) wherein the major axes (54) of the first tubes (16) define respective preselected angles (A) with the first core axis (44), said angles ($A_4$) of all tubes (164) in the central portion of the first core (12) being of the same magnitude and less than 90°, said angles ($A_3$,$A_2$,$A_1$) of the tubes (163,162,161) nearest each end (28,40) of the first core(12) being less than the angles ($A_4$) of all tubes (164) in the central portion of the first core (12) and also progressively-decreasing in magnitude from the central portion to the respective inlet and outlet ends (28,40) of the first core (12), a second core (18) having an inlet end (30), a central portion, an outlet end (42), and a longitudinal axis (46) extending from the inlet end (30) to the outlet end (42), said second core (18) oriented in a general "V" configuration with the first core (12) and spaced a preselected distance therefrom such that the first and second core axes (44,46) form a preselected included angle less than 180°, said second core (18) including a second plurality of stacked and generally spaced fins (20) each being of a generally straight elongated configuration and a second plurality of tubes (22) extending generally perpendicular through the fins (20) of the second core (18) and arranged in a single substantially-straight row between the inlet and outlet ends (30,42) of the second core (18), each of said second tubes (22) having an elongated cross-sectional configuration defining a respective longitudinal major axis (56) wherein the major axes (56) of the second tubes (22) define respective preselected angles (C) with the second core axis (46), said angles ($C_4$) of all tubes (224) in the central portion of the second core (18) being of the sme magnitude and less than 90°, said angles ($C_3$,$C_2$,$C_1$) of the tubes (223,222,221) nearest each end (30,42) of the second core (18) being less than the angles ($C_4$) of all tubes (224) in the central portion of the second core (18) and also progressively-decreasing in magnitude from the central portion to the respective inlet and outlet ends (30,42) of the second core (18).

* * * * *